United States Patent [19]

Köppl

[11] Patent Number: 4,499,351

[45] Date of Patent: Feb. 12, 1985

[54] HIGH-VOLTAGE SWITCH AND ITS USE

[75] Inventor: Georg Köppl, Birr, Switzerland

[73] Assignee: BBC Brown, Boveri & Company, Limited, Baden, Switzerland

[21] Appl. No.: 460,360

[22] Filed: Jan. 24, 1983

[30] Foreign Application Priority Data

Jan. 28, 1982 [CH] Switzerland ..... 518/82

[51] Int. Cl.[3] ..... H01H 33/91

[52] U.S. Cl. ..... 200/148 R; 200/61.08; 200/150 M

[58] Field of Search ..... 361/3; 200/148 R, 61.08, 200/150 M

[56] References Cited

U.S. PATENT DOCUMENTS 4,354,072 10/1982 Noeske ..... 200/148 R

FOREIGN PATENT DOCUMENTS 321671 6/1957 Switzerland .

OTHER PUBLICATIONS

Natsui et al., "Experimental Approach to One-Cycle Puffer Type $SF_6$ Gas Circuit Breaker", IEEE Transaction on Power Apparatus and Systems, vol. Pas-99, No. 3, May/Jun. 1980, pp. 833-840.

*Primary Examiner*—A. D. Pellinen
*Assistant Examiner*—Morris Ginsburg
*Attorney, Agent, or Firm*—Burns, Doane, Swecker & Mathis

[57] ABSTRACT

To provide a high-voltage switch which can switch off in a very short time, namely in a half-period, rapid severing of the isolating screws (36) is utilized, and the high-voltage switch is designed so that the switch-off and switch-on device contains at least one isolating screw (36) by means of which a prestressed rod (28) connected to the movable contact of the high-voltage switch can be released. The half-period high-voltage switch according to the invention is used appropriately in switching systems where the half-period high-voltage switch is connected in series with at least one power circuit-breaker. The advantage is to be seen especially in the use of the high-voltage switch in switching systems where it permits a limited short-circuit cut-out capacity.

5 Claims, 8 Drawing Figures

HIGH-VOLTAGE SWITCH AND ITS USE

Figure 1:
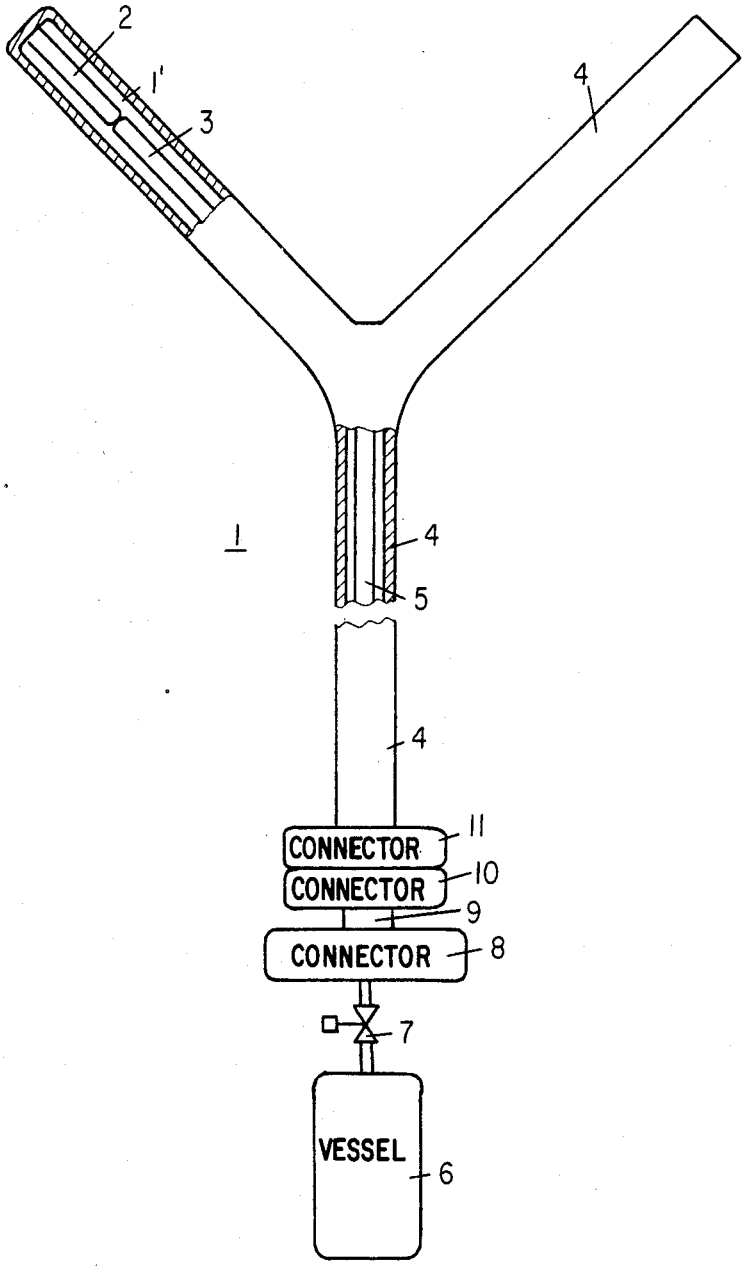

The following patent application relates to a high-voltage switch with at least one movable contact and with a switch-off and switch-on device, and to a use of the high-voltage switch.

High-voltage switches of this type are known. As regards the practical use of the high-voltage switches, it is favorable if the switch-off and switch-on operations are carried out as rapidly as possible. In IEEE Transaction on Power Apparatus and System, Volume PAS-99, No. 3 May/June 1980, a single-period switch of the $SF_6$ type is described and illustrated on pages 833 et seq. This publication also expresses the expectation that it will soon be possible actually to produce a switch with the switch-off time of one period. A disadvantage of this solution is that the short-circuit current flows during at least one period. Nevertheless, this solution already represents a success in comparison with the high-voltage switches conventional hitherto.

The object of the invention is to reduce further, specifically to a half period, the time during which the short-circuit current flows.

The aforesaid object is achieved, in a high-voltage switch of the type mentioned in the introduction, due to the fact that the switch-off device 11 and the switch-on device 8 contains at least one isolating screw 36 by means of which a prestressed rod 28 connected to the movable contact 3 can be released.

The advantage of the invention is to be seen especially in the fact that because the current is switched off very quickly not only are the contacts of the high-voltage switch protected, but also, when a power circuit-breaker is assigned to it, a limited short-circuit cut-out capacity is possible.

Figure 2:
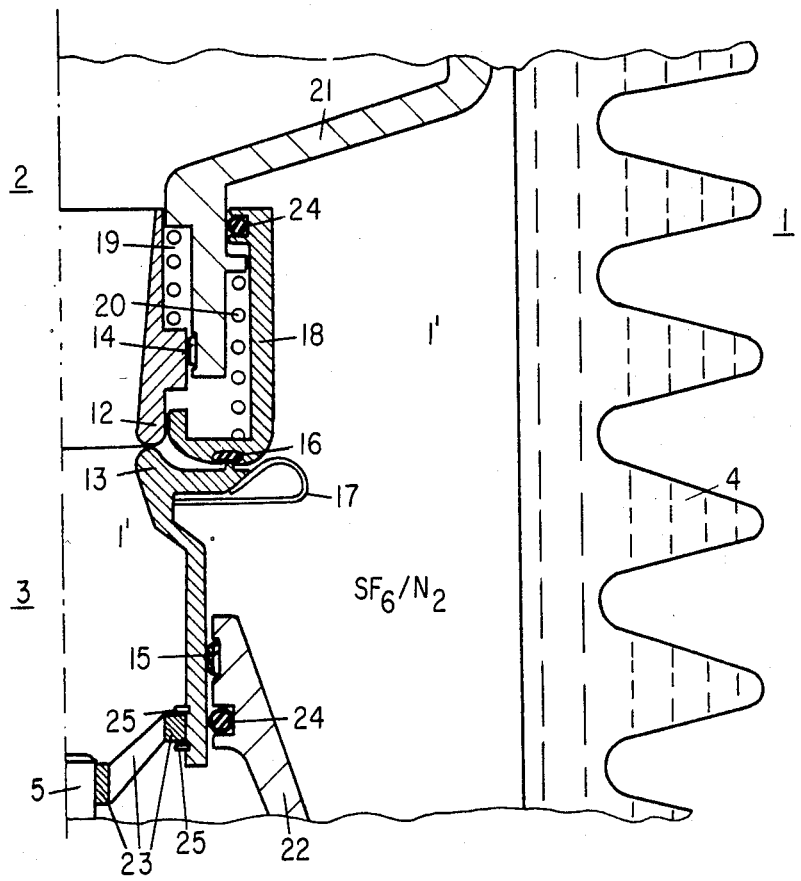
Figure 3:
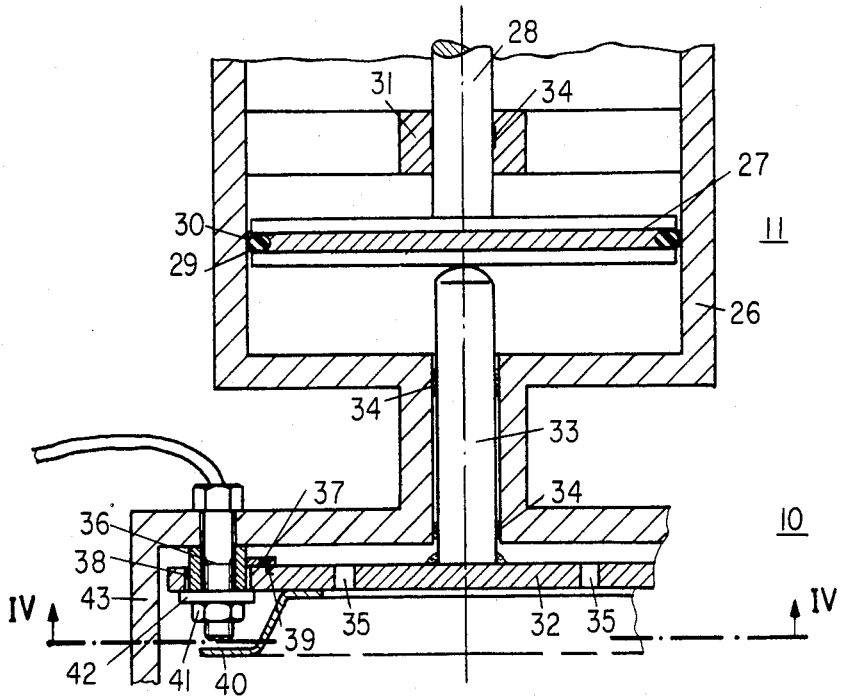
Figure 4:
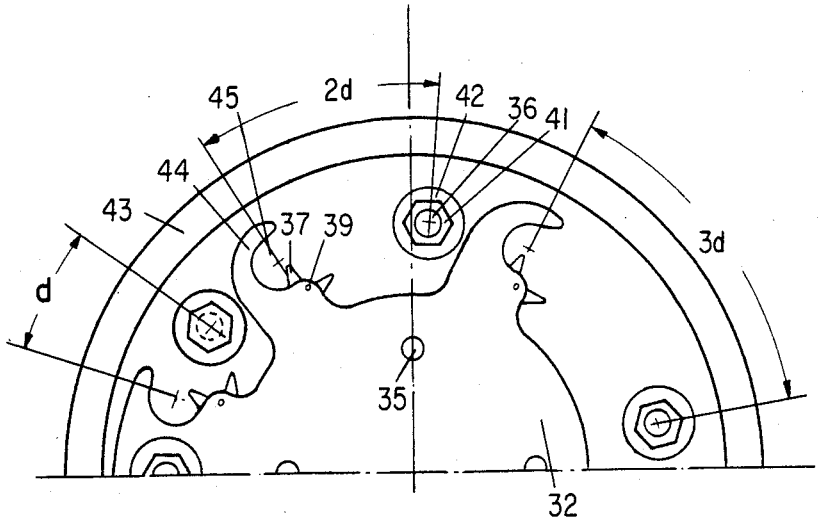
Figure 5:
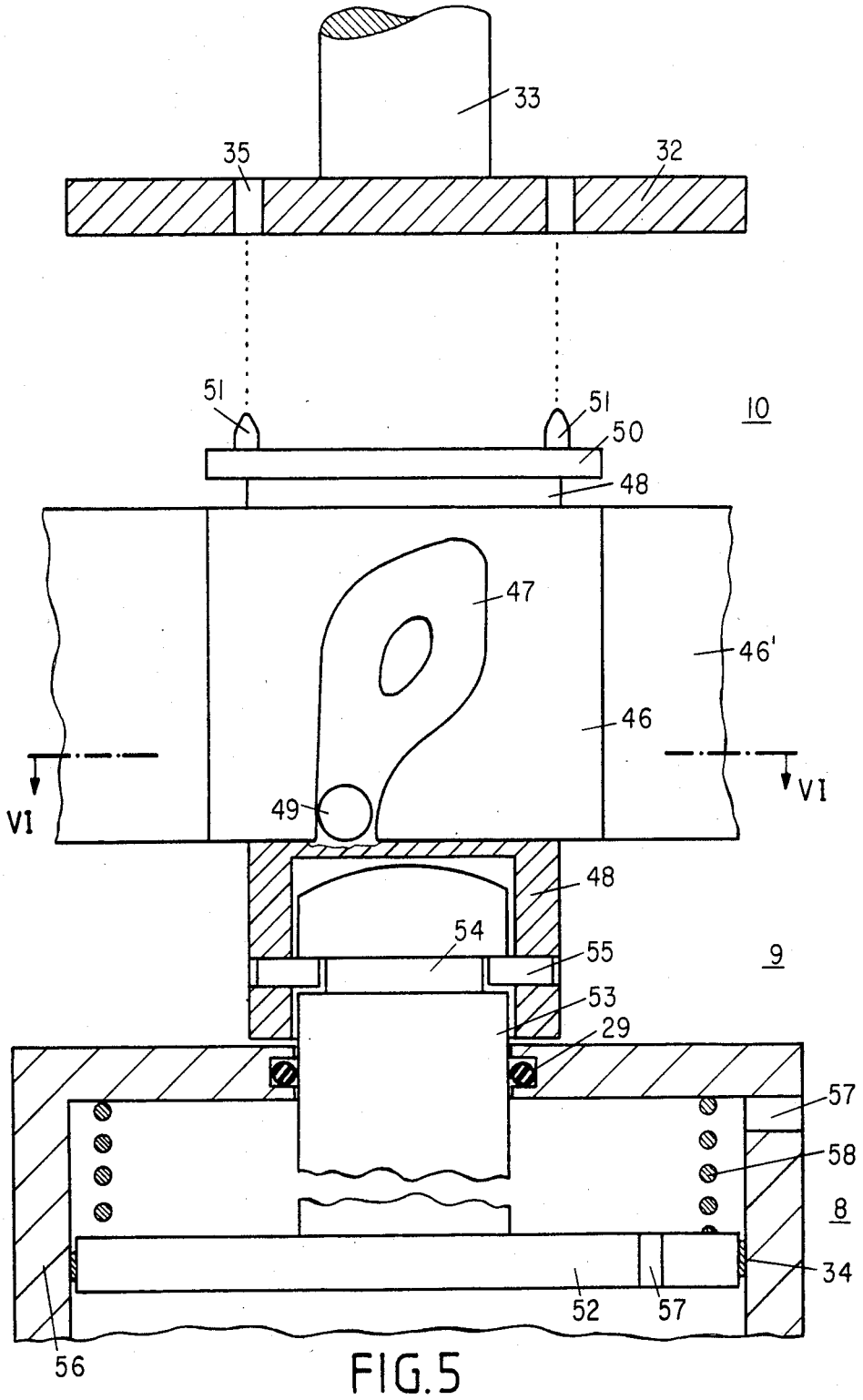
Figure 6:
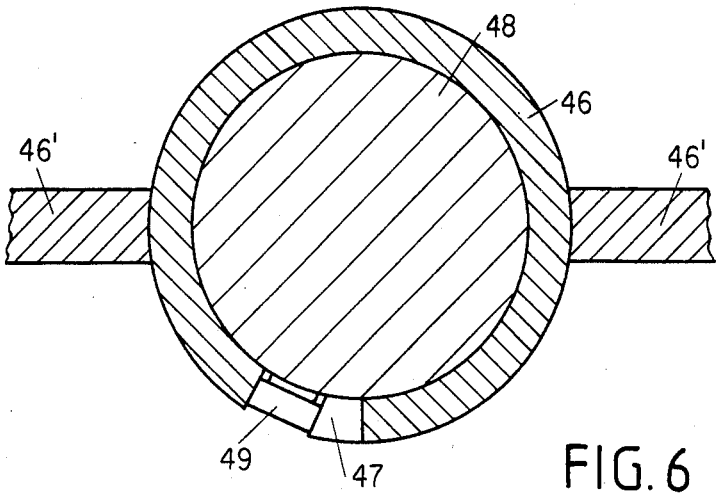
Figure 7:
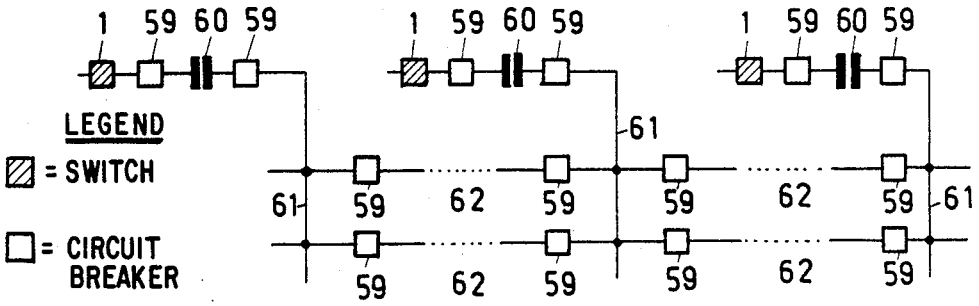
Figure 8:
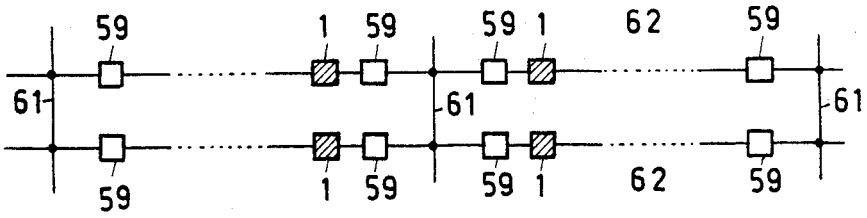

In the drawing:

FIG. 1 shows an exemplary embodiment according to the invention of the half-period high-voltage switch, FIG. 2 shows a partial section through the quenching chamber of the half-period high-voltage switch, FIG. 3 shows a section through a rotary device shown only simplified in FIG. 1, FIG. 4 shows the section IV—IV from FIG. 3, FIG. 5 shows a section through the rotary device shown only symbolically in FIG. 1, with a connecting part, FIG. 6 shows the section VI—VI from FIG. 5, FIG. 7 shows an exemplary use of the half-period high-voltage switch in a switching system, and FIG. 8 shows another use of the half-period high-voltage switch according to the invention.

FIG. 1 shows the overall arrangement of the half-period high-voltage switch 1 according to the invention. This drawing shows in a partial section a fixed contact 2 and a movable contact 3 which are located in a quenching chamber 1', an insulating casing 4 and an insulating rod 5 being shown in a further section. Further functional parts of the half-period high-voltage switch are shown diagrammatically in the bottom part of FIG. 1. A high-pressure vessel 6 is connected via a topping-up valve 7 to a device 8 with a switch-on piston. A connecting part 9 leads to a rotary device 10, the continuation of which is a device 11 with a switch-off piston. The detailed designs of the individual parts are explained in more detail with reference to the following drawings.

The reference numerals denote the same parts in all the drawings.

FIG. 2 illustrates a section through part of a quenching chamber 1'. The fixed contact 2 is provided with a contact body 12. The movable contact 3 has a contact body 13. The fixed contact 2 contains a sliding contact 14, and the movable contact 3 contains a sliding contact 15. A gasket 16 is fastened between the bodies 12 and 18. The contact body 13 is provided with a shield 17. The contact body 12 is pressed into its contact position by means of a cylindrical compression spring 19, a further cylindrical compression spring 20 being assigned to the body 18. The fixed contact 2 is connected by means of a current feed 21 to a connection contact not shown. The sliding contact 15 has a current feed 22 in which an annular gasket 24 is mounted. The movable contact 3 also contains a connecting star 23 which is connected to the insulating rod 5. The connecting star 23 is retained by means of two rings 25.

In FIG. 3, the device 11 and, in part, the rotary device 10 from FIG. 1 are explained in more detail. A switch-off piston 27 is mounted displaceably in a cylindrical housing 26. This switch-off piston 27 is connected to a piston rod 28 and is provided with a sealing ring 29 mounted in a groove 30. The piston rod 28 is guided by means of a star-shaped retaining device 31. The bottom part of FIG. 3 shows an engagement disc 32 of the rotary device 10. To make it easier to understand the construction of this engagement disc 32, the section IV—IV shown in FIG. 3 should also be considered. The engagement disc 32 is provided with a tappet 33 which touches the switch-off piston 27. The tappet 33 is guided in two guide rings 34. The engagement disc 32 is provided with two bores 35. For the sake of clarity, only one isolating screw 36 is shown in FIG. 3. The position of the remaining isolating screws 36 is visible in FIG. 4. Several tilting segments 37 are fastened rotatably by means of bearing bolts 39 in the engagement disc 32. The isolating screws 36 are provided with spacer sleeves 38. Fastened under the isolating screws 36 is a protective plate 40, the function of which is to prevent the lower parts of the isolating screws 36 from falling out. The reference numeral 41 denotes the nut of the isolating screw 36, this nut 41 being assisted by a cup spring 42. The rotary device 10 is provided with a cylindrical housing 43, both the cylindrical housing 43 and the cylindrical housing 26 with corresponding disc-shaped plates being shown in one piece for the sake of simplicity. It goes without saying that they consist of several parts for assembly reasons. As may be seen clearly in FIG. 4, the engagement disc 32 has hook-shaped parts 44, in which recesses 45 are made to provide support in engagement with the isolating screws 36.

FIG. 5 shows, in section, an exemplary embodiment of the connecting part 9 from FIG. 1, the engagement disc 32 from FIGS. 3 and 4 also being shown simplified in this FIG. 5. A bolt 48 is mounted in a sleeve 46 of the rotary device 10. The sleeve 46 is retained by means of two supporting arms 46' which can also be seen clearly in the section VI—VI shown in FIG. 6. The sleeve 46 is provided with a slot-like recess 47 forming a loop. There engages into this slot-like recess 47 a roller 49 which is mounted rotatably in the bolt 48. The bolt 48 carries a plate 50 which is provided with two pegs 51. These pegs 51 serve for engaging into the bores 35 in the engagement disc 32. The bottom part of FIG. 5 shows a switch-on piston 52 connected to a switch-on tappet 53. The switch-on tappet 53 has an annular groove 54 into which engage two fixing bolts 55 shown only symbolically, which are pressed into the bolt 48 and which permit the rotary movement of the bolt 48 with respect to the switch-on tappet 53. The device 8 with the switch-on piston 52 is provided with a cylindrical housing 56 in which a bore 57 is made. The switch-on piston 52 is supported with respect to the cylindrical housing 56 by means of a compression spring 58.

FIG. 6 shows the section VI—VI from FIG. 5. This Figure illustrates clearly the position of the roller 49 in the slot-like recess 47 of the sleeve 46 of the rotary device 10.

FIGS. 7 and 8 show two examples of the use of the high-voltage switch 1 according to the invention. Reference numeral 59 denotes power circuit-breakers, 60 denotes transformers, 61 denotes busbars and 62 denotes lines. As is evident from FIG. 7, a half-period high-voltage switch 1 is connected in series with each power circuit-breaker 59, and this series connection respectively feeds via a transformer 60 the appropriate busbar 61. The exemplary circuit according to FIG. 8 shows an alternative form in which the half-period high-voltage switch 1 according to the invention is connected in series with a power circuit-breaker 59 directly in each of the lines 62 of the switching system.

The component which is most important for the rapid mode of operation of the half-period high-voltage switch 1 according to the invention is defined, in this example, by the isolating screws 36 in co-operation with the engagement disc 32. The isolating screws are known per se. They are screws which receive a release pulse via an ignition control (not shown), and they are burst off in the desired zone and are rivetted in the retention means.

The mode of operation of the half-period high-voltage switch can already be seen, in practice, from the drawings and from the description of these.

When the half-period high-voltage switch 1 is switched off, the mode of operation is as follows: when a release system detects a fault current which will exceed a predetermined threshold value, it transmits a release pulse to the isolating screw 36 retaining the prestressed piston rod 28. When several isolating screws 36 are used in a device, the ignition control transmits the release pulse to the isolating screw or isolating screws 36 which are just engaged with the engagement disc 32. The isolating screw 36 is burst off and breaks the mechanical connection between the cylindrical housing 43 of the rotary device 10 and the engagement disc 32. Located in the outer part of the quenching chamber 1' is the gas mixture $SF_6/N_2$ which has penetrated into the quenching chamber 1' from the high-pressure vessel 6 through the switch column. After the isolating screw 36 has been burst off, the switch-off piston 27 accelerates the movable contacts 3 under the effect of the constantly prevailing gas-mixture pressure. The gasket 16 in the quenching chamber 1' opens and opens the way for the pressure to be applied to the contacts 12, 13. After the contacts have been separated, the arc is blown in sharp focus and is quenched in the zero passage. The power circuit-breaker 59 opening as a result forms the isolation.

The currentless switching-on of the half-period high-voltage switch 1 follows immediately on the switching-off. The topping-up valve 7 of the high-pressure vessel 6 is opened, and the $SF_6/N_2$ mixture flowing into the switch column flows under the switch-on piston 52 and moves the latter in the switching-on direction. The switch-on piston 52 carries the bolt 48 of the rotary device 10 along with it. The engagement disc 32 fixed by means of the pegs 51 is likewise carried along and at the end of the movement is locked in an intact isolating screw 36. The switch-off piston 27 and the elements connected firmly to it, namely the insulating rod 5 and the movable contacts 3, are likewise carried along and moved in the switching-on direction. When the pressure in the high-voltage switch 1 has reached its nominal value again, the topping-up valve 7 is closed off, and the high-voltage switch 1 is ready again for switching-off.

It goes without saying that the subject of the invention is not restricted to what is illustrated in the drawing. Thus, for example, only one isolating screw 36 may be used, but this has to be exchanged after each switching-off and switching-on operation. This disadvantage is partially compensated because the construction of the switch-off and switch-on device can be simplified. The subject of the invention is also suitable for types of switches other than that illustrated.

I claim:

1. A high-voltage switch controlling a circuit breaker comprising at least one movable contact, a switch-on device, a switch-off device and at least one isolating screw, a rotary engagement disc provided with at least one recess and rotatably mounted in a housing, said at least one isolating screw fastened to said housing so as to be releasably connected to said at least one recess of the rotary engagement disc wherein upon disengagement of the at least one isolating screw from the rotary engagement disc, a piston rod connected to said at least one movable contact is released and said circuit breaker is opened.

2. A high-voltage switch according to claim 1, wherein a plurality of isolating screws are fastened to the housing at the same circumferential distance from the axis of rotation of the rotary disc.

3. A high-voltage switch according to claim 1, wherein a first of the isolating screws is fastened to the housing of the rotary disc and to the rotary engagement disc.

4. A high-voltage switch according to claim 2, wherein the isolating screws and the at least one recess of the rotary engagement disc are releasably connected in incremental steps in the direction of the axis of rotation of the rotary engagement disc.

5. A high-voltage switch according to claim 2, wherein the switch-on device includes a slot-like rotary guide defined by a roller element which is rotatably arranged in a bolt, said roller element slidably received in a slot-like recess which forms a loop along an inner wall of a sleeve so as to drive said rotary engagement disc into contact with one of said isolating screws and thereby close said circuit breaker.

* * * * *